US006265361B1

(12) United States Patent
Akiyama et al.

(10) Patent No.: US 6,265,361 B1
(45) **Date of Patent: *Jul. 24, 2001**

(54) BEARING GREASE COMPOSITION FOR MOTOR

(75) Inventors: Motoharu Akiyama, Kitasaku-gun; Seiji Okamura; Yasuhiro Miyamoto, both of Kobe, all of (JP)

(73) Assignee: Minebea Co., Ltd., Miyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/518,186

(22) Filed: Mar. 2, 2000

(30) Foreign Application Priority Data

Sep. 8, 1999 (JP) ..... 11-292734

(51) Int. Cl.[7] ..... C10M 169/02; C10M 105/48

(52) U.S. Cl. ..... 508/462; 508/465; 508/496; 508/539

(58) Field of Search ..... 508/462

(56) References Cited

U.S. PATENT DOCUMENTS

| | | | | |
|---|---|---|---|---|
| 2,739,127 | * | 3/1956 | Morway et al. | 508/462 |
| 4,322,305 | * | 3/1982 | Lewis | 508/462 |
| 5,009,803 | * | 4/1991 | Brandolese | 508/462 |
| 5,223,161 | * | 6/1993 | Waynick | 508/177 |
| 5,385,682 | * | 1/1995 | Hutchings et al. | 508/178 |
| 5,387,374 | * | 2/1995 | Westfechtel et al. | 508/462 |
| 5,595,965 | * | 1/1997 | Wiggins | 508/491 |
| 5,668,092 | * | 9/1997 | Denton | 508/146 |
| 5,714,444 | | 2/1998 | Yokouchi et al. | 508/539 |

FOREIGN PATENT DOCUMENTS

| | | |
|---|---|---|
| 0 987 312 A1 | 3/2000 | (EP) . |
| 8-034987 | 6/1996 | (JP) . |
| 12-63874 | 2/2000 | (JP) . |

* cited by examiner

*Primary Examiner*—Ellen M. McAvoy
(74) *Attorney, Agent, or Firm*—Oliff & Berridge, PLC

(57) ABSTRACT

A grease composition with which low torque property, low noise property and low volatilization property can be maintained, is provided. The grease composition is characterized in that it contains:

(A) an alkali metal salts and/or an alkaline earth metal salt synthesized from a hydroxide of an alkali metal or an alkaline earth metal, and a higher fatty acid having 10 or more carbon atoms or a higher hydroxyfatty acid having at least one hydroxyl group and 10 or more carbon atoms;

(B) a carbonate compound represented by the general formula:

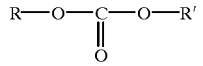

(R and R' represent a branched alkyl group having 13–15 carbon atoms, and may be same or different); and (C) at least one kind of an ester-based synthetic oil selected from the group consisting of a diester-based synthetic oil represented by the general formula (i):

$$ROCO\ (CH_2)_nCOOR' \quad \text{(i)}$$

(R and R' represent an alkyl group having 3–18 carbon atoms, and may be the same or different, and n is 3–12);

a triester-based synthetic oil represented by the general formula (ii):

$$C_2H_5C(CH_2OCOR)_3 \quad \text{(ii)}$$

(R represents an alkyl group having 3–10 carbon atoms);

a tetraester-based synthetic oil represented by the following general formula (iii):

$$C\ (CH_2OCOR)_4 \quad \text{(iii)}$$

(R represents an alkyl group having 3–10 carbon atoms), and other neopentyl polyol ester-based synthetic oil.

7 Claims, No Drawings

BEARING GREASE COMPOSITION FOR MOTOR

BACKGROUND OF THE INVENTION

1. Field of the Invention

The present invention relates to a grease composition, and more particularly to a carbonate-based grease composition having such excellent characteristics that rotating torque is small, noise is small and life is long when the grease of the present invention is sealed in a bearing.

2. Description of the Related Art

Recently, earth environmental problem is particularly closed up, and an effort to reduce consumption of wasteful energy as less as possible is obligated to advanced countries. As one conclusion of energy saving problem, it is the current demand for using DC motor having good efficiency in place of AC motor. In particular, in fan motors of air conditioners for appliances, it has been approaching the age that DC motor having good efficiency is used in place of AC motor that has still the limitation even though a converter is provided to change an output.

In general, the performances required to a bearing grease composition used in a small-sized motor for use in appliances or the like are such that torque is small, acoustic performance is excellent, leakage (volatilization) is small and life is long.

A lithium soap-based grease using a mineral oil as a base oil, or a lithium soap-based grease using, as a base oil, a synthetic ester (diester oil, polyol ester oil or the like) that is a reaction product of an organic acid and an alcohol has conventionally been used as the bearing grease for motor, but it is the actual circumstances that further improvement is still required.

A lithium soap-based grease using a mineral oil as a base oil has been used as a general-purpose grease for many years, but has had the problems that for a small-sized motor, a thickening agent has poor dispersibility in a grease, acoustic and vibration properties at the rotation of bearing are not good, and temperature range of use is narrow.

Further, a lithium soap-based grease using, as a base oil, a synthetic ester (diester oil, polyol ester oil or the like) that is a reaction product of an organic acid and an alcohol has good dispersity of the lithium soap. Therefore, there is no problem on acoustic and vibration performances at the rotation of bearing, and the wide temperature range of use due to the use of a synthetic oil was preferable. However, this grease had the problem in low torque property that is the essential element inmotors for appliances in recent years.

SUMMARY OF THE INVENTION

The present invention has solved the problems associated with the prior art, and therefore has an object of the invention to provide a grease composition with stable low torque property, low noise property and low volatilization property that can be maintained when it is used as the grease for a bearing of a motor.

In the present invention, it has been found that by using a grease composition containing a carbonate represented by the general formula (I) and an ester-based synthetic oil, as a base oil, and a metallic soap, the characteristics particularly required in the bearing grease composition used in small-sized motor for appliances for home use or the like are satisfied.

Therefore, the grease composition of the present invention is characterized in that it contains: (A) an alkali metal salt and/or an alkaline earth metal salt synthesized from a hydroxide of an alkali metal or an alkaline earth metal, and a higher fatty acid having 10 or more carbon atoms or a higher hydroxyfatty acid having at least one hydroxyl group and 10 or more carbon atoms; (B) a carbonate compound represented by the general formula:

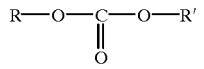

(R and R' represent a branched alkyl group having 13–15 carbon atoms, and may be same or different); and (C) at least one kind of an ester-based synthetic oil selected from the group consisting of a diester-based synthetic oil represented by the general formula (i):

$$ROCO(CH_2)_nCOOR' \quad \text{(i)}$$

(R and R' represent an alkyl group having 3–18 carbon atoms, and may be the same or different, and n is 3–12);

a triester-based synthetic oil represented by the general formula (ii):

$$C_2H_5C(CH_2OCOR)_3 \quad \text{(ii)}$$

(R represents an alkyl group having 3–10 carbon atoms), a tetraester-based synthetic oil represented by the following general formula (iii):

$$C(CH_2OCOR)_4 \quad \text{(iii)}$$

(R represents an alkyl group having 3–10 carbon atoms); and other neopentyl polyol ester-based synthetic oil.

The grease of the present invention is that the combination itself of components is novel, and any proportion can be used as the grease.

The blending ratio of each component is desirably that the alkali metal salt and/or alkaline earth metal salt of the component (a) is 5–30 parts by mass and the mixed base oil composed of the carbonate compound of the component (b) and the ester-based synthetic oil of the component (C) is 70–95 parts by mass.

More preferably, the alkali metal salt and/or alkaline earth metal salt of the component (a) is 10–25 parts by mass and the mixed base oil composed of the carbonate compound of the component (b) and the ester-based synthetic oil of the component (C) is 75–90 parts by mass.

If the alkali metal salt and/or alkaline earth metal salt of the component (a) is less than 5 parts by mass, the mixture consistency becomes soft and there is the possibility of leakage or scatter at the rotation of bearing, which requires attention. On the other hand, if it exceeds 30 parts by mass, the grease becomes too hard. As a result, fluidity of the grease inside the bearing lowers and there is the possibility to cause poor lubrication, which requires attention.

Next, the ratio of the carbonate compound (B) used as the base oil in the grease composition of the present invention and the ester-based synthetic oil is preferable that (B)/[(B)+(C)] is 0.1 or more and less than 0.95 by mass ratio.

More preferably, (B)/[(B)+(C)] is 0.2 or more and 0.8 or less by mass ratio. If (B)/[(B)+(C)] is less than 0.1, there is no effect of torque decrease, and if it is 0.95 or more, the volatility becomes too high.

Further, the grease composition of the present invention can contain various additives generally used in greases.

Examples of the additives are additives generally used in grease compositions, for example, oxidation inhibitors such as phenyl α(β) naphthylamine, alkyl diphenylamine, phenothiazine or t-butylphenol, and rust preventives such as metal sulfonate, nonionic types or amine types.

DESCRIPTION OF THE PREFERRED EMBODIMENT

Representative examples of the alkali metal salt and/or alkaline earth metal salt used as the component (A) in the present invention include lithium stearate and lithium 12 hydroxystearate.

The representative example of the carbonate compound used as the component (B) in the present invention is a compound represented by the following formula:

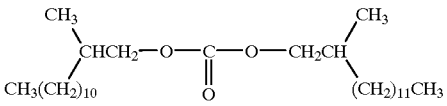

Further, examples of the ester-based synthetic oil used as the component (C) in the present invention include di-2-ethylhexyl sebacate, di-2-ethylhexyl azerate, di-2-ethylhexyl adipate, trimellitic acid ester, trimethylol propane ester, pentaerythritol ester and the like.

Preferred embodiment of the present invention is described below.

(1) A grease composition, characterized in that it contains:

(A) an alkali metal salt and/or an alkaline earth metal salt synthesized from a hydroxide of an alkali metal or an alkaline earth metal, and a higher fatty acid having 10 or more carbon atoms or a higher hydroxyfatty acid having at least one hydroxyl group and 10 or more carbon atoms; (B) a carbonate compound represented by the general formula:

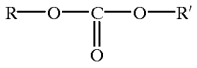

(R and R' represent a branched alkyl group having 13–15 carbon atoms, and may be same or different); and (C) at least one kind of an ester-based synthetic oil selected from at the group consisting of a diester-based synthetic oil represented by the general formula (i):

$$ROCO(CH_2)_nCOOR' \quad (i)$$

(R and R' represent an alkyl group having 3–18 carbon atoms, and may be the same or different, and n is 3–12);

a triester-based synthetic oil represented by the general formula (ii):

$$C_2H_5C(CH_2OCOR)_3 \quad (ii)$$

(R represents an alkyl group having 3–10 carbon atoms), a tetraester-based synthetic oil represented by the following general formula (iii):

$$C(CH_2OCOR)_4 \quad (iii)$$

(R represents an alkyl group having 3–10 carbon atoms); and other neopentyl polyol ester-based synthetic oil.

(2) A grease composition described in (1) above, wherein the component (A) is 5–30 parts by mass and the mixed base oil component comprising the component (B) and the component (C) is 70–95 parts by mass.

(3) A grease composition, characterized in that it contains: 5–30 parts by mass of (A) an alkali metal salt and/or an alkaline earth metal salt synthesized from a hydroxide of an alkali metal or an alkaline earth metal, and a higher fatty acid having 10 or more carbon atoms or a higher hydroxyfatty acid having at least one hydroxyl group and 10 or more carbon atoms;

(B) a carbonate compound represented by the following general formula

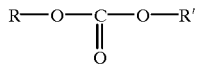

(R and R' represent a branched alkyl group having 13–15 carbon atoms, and may be same or different); and (C) at least one kind of an ester-based synthetic oil selected from the group consisting of a diester-based synthetic oil represented by the general formula (i):

$$ROCO(CH_2)_nCOOR' \quad (i)$$

(R and R' represent an alkyl group having 3–18 carbon atoms, and may be the same or different, and n is 3–12), a triester-based synthetic oil represented by the general formula (ii):

$$C_2H_5C(CH_2OCOR)_3 \quad (ii)$$

(R represents an alkyl group having 3–10 carbon atoms);

a tetraester-based synthetic oil represented by the general formula (iii):

$$C(CH_2OCOR)_4 \quad (iii)$$

(R represents an alkyl group having 3–10 carbon atoms);

and other neopentyl polyol ester-based synthetic oil, wherein the grease composition contains 70–95 parts by mass of a mixed base oil wherein a mixing ratio of the carbonate compound (B) and the ester-based synthetic oil (C) is such that (B)/[(B)+(C)] is 0.1 or more and less than 0.95 in terms of mass ratio.

(4) The grease composition described in any one of (1) to (3) above, which uses the carbonate compound wherein R and R' are a branched alkyl group represented by the general formula:

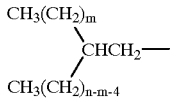

and may be the same or different (n is an integer of 13–15, and m is an integer of 0–6).

(5) The grease composition as described in any one of (1) to (4) above, wherein the component (C) is the diester-based synthetic oil represented by the formula (i):

$$ROCO(CH_2)_nCOOR' \quad (i)$$

(R and R' represent an alkyl group having 3–18 carbon atoms, and may be the same or different, and n is 3–12).

(6) The grease composition as described in any one of (1) to (5) above, wherein the component (C) is the tetraester-based synthetic oil represented by the general formula (iii):

$$C(CH_2OCOR)_4 \quad (iii)$$

(R represents an alkyl group having 3–10 carbon atoms), (7) The grease composition described in any one of (1) to (6) above, which is used as the grease for a bearing of a small-sized motor.

The present invention is described in more detail based on the examples.

EXAMPLES

In Examples 1–6, lithium stearate or lithium 12 hydroxystearate was used as the alkali metal salt, a carbonate containing an organic carbonate containing a branched alkyl having 13–15 carbon atoms represented by the following formula:

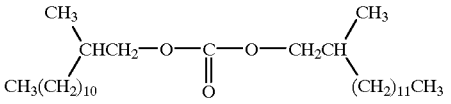

is used as the carbanate, and a tetraester oil and/or a diester oil were used as the ester-based synthetic oil. DOS(di-2-ethylhexyl sebacate) was used as the diester oil, and PE (pentaerythritol ester) was used as the tetraester oil. Components were mixed in the proportion as shown in Table 1 such that the sum of lithium stearate and lithium 12 hydroxystearate was 100 mass %, and while mixing until the whole became liquid, the mixture was heated to 220–230° C. The mixture was poured in a stainless steel vessel at a thickness of 3–5 mm, cooled to 50° C or lower and homogenized with three rolls, thereby obtaining a grease composition.

The component proportion and test results of the grease composition are shown in Table 1.

TABLE 1

| Example | | 1 | 2 | 3 | 4 | 5 | 6 |
|---|---|---|---|---|---|---|---|
| Thickening agent | StLi | | | 20 | | 2 | 20 |
| | 12OH St-Li | 16 | 12 | | 12 | 10 | |
| Base oil | Carbonate | 33.6 | 35.2 | 32 | 52.8 | 35.2 | 20 |
| | Tetraester oil | 50.4 | 52.8 | 48 | | 52.8 | 50 |
| | Diester oil | | | | 35.2 | | 10 |
| Base oil viscosity (40° C.) | | 26 | 26 | 26 | 15 | 26 | 26 |
| Mixture consistency (25° C.) | | 185 | 230 | 202 | 221 | 245 | 210 |
| Dropping point ° C. | | 201 | 193 | 197 | 198 | 196 | 197 |
| Bearing property test | Acoustic property | A | A | A | A | A | A |
| | Low torque property | A | A | A | A | A | A |
| | Low volatilization property | A | A | A | B | B | B |
| | Long life property | A | A | A | A | A | A |
| Total evaluation | | A | A | A | B | B | B |

Comparative Example 1

Further, for comparison, two kinds of commercially available greases in which a base oil and a thickening agent were known were used as Comparative Examples 1 and 2, and the results are shown in Table 2. In Table 2, the mark + shows the component blended. Further, a base oil not containing the component (C) and lithium soap were blended in the proportion shown in Table 2, and a grease composition was obtained in the same manner as in Examples. This was shown as Comparative Example 3.

Mixture consistency, dropping point and bearing characteristic tests shown below were conducted under the same conditions on the grease compositions of the Examples and the Comparative Examples, and the results obtained are shown in Table 2.

TABLE 2

| Comparative grease | 1 | 2 | 3 |
|---|---|---|---|
| Thickening agent | | | |
| StLi | + | + | 15 |
| 12OH St-Li | + | + | 5 |
| Base oil | | | |
| Carbonate | | | 80 |
| Tetraester oil | + | | |
| Diester oil | + | | |
| Mineral oil | | + | |
| Base oil viscosity (40° C.) | 26 | 100 | 18 |
| Mixture consistency (25° C.) | 250 | 280 | 181 |
| Dropping point ° C. | 194 | 190 | 195 |
| Bearing property test | | | |
| Acoustic property | A | D | A |
| Low torque property | D | D | A |
| Low volatilization property | D | B | D |
| Long life property | A | D | C |
| Total evaluation | D | D | C |

The mixture consistency was determined according to JISK2220 5.3, and the dropping point was determined according to JIS K2220 5.4.

The bearing characteristic tests were conducted such that a grease composition which is a sample to be measured was sealed in a small-sized bearing, and rotating torque, acoustic properties at ordinary temperature, volatilization amount after 1000 hours in a bearing rotation test at an ambient temperature of 100° C. at a number of revolution of 3,000 rpm, and acousticproperties (acoustic life) of the bearing were measured.

The acoustic properties was measured as Anderon value with an Anderon meter before and after the bearing rotation test.

The rotating torque was measured with a torque tester at 3000 rpm with 2 kg load at room temperature.

The volatilization amount was determined from the difference in weight of the bearing measured before and after the bearing rotation test. Regarding each of evaluation results, the judgement results according to the performance required for the bearing grease composition for motor are shown in Table 1 (Examples) and Table 2 (Comparative Examples). The smaller Anderon value, the lower torque, and the smaller volatilization amount respectively mean the better acoustic properties.

The evaluation was made with the following four grades.

A: particularly excellent

B: excellent

C: ordinary

D: poor

The unit of viscosity of the base oil is $mm^2/s$.

As is apparent from Table 1 and Table 2, it was confirmed that the bearing in which the grease composition of the present invention is sealed exhibits low torque property, low noise property and low volatilization property, as compared with the conventional grease composition.

What is claimed is:

1. A grease composition for motor bearings, comprising:

(A) a thickener comprising, an alkali metal salt and/or an alkaline earth metal salt synthesized from a hydroxide of an alkali metal or an alkaline earth metal, and a higher fatty acid having 10 or more carbon atoms or a higher hydroxyfatty acid having at least one hydroxyl group and 10 or more carbon atoms; and a base oil comprising a mixture of a carbonate compound (B) and an ester-based synthetic oil (C);

wherein the carbonate compound (B) is represented by the following general formula:

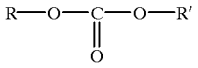

wherein R and R' represent a branched alkyl group having 13–15 carbon atoms, and may be same or different; and wherein the ester-based synthetic oil (C) is selected from the group consisting of a diester-based synthetic oil represented by the following general formula:

$$ROCO(CH_2)_nCOOR'$$

wherein R and R' represent an alkyl group having 3–18 carbon atoms, and may be the same or different, and n is 3–12;

a triester-based synthetic oil represented by the following general formula:

$$C_2H_5C(CH_2OCOR)_3$$

wherein R represents an alkyl group having 3–10 carbon atoms; and a tetraester-based synthetic oil represented by the following general formula:

$$C(CH_2OCOR)_4$$

wherein R represents an alkyl group having 3–10 carbon atoms; and other neopentyl polyol ester-based synthetic oil.

2. A grease composition for motor bearings as claimed in claim 1, wherein R and R' of the carbonate compound (B) are a branched alkyl group represented by the following general formula

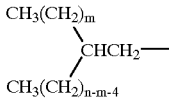

wherein n is an integer of 13–15 and m is an integer of 0–6, and R and R' can be the same or different.

3. A grease composition for motor bearings as claimed in claim 1, wherein the ester-based synthetic oil (C) is the diester-based synthetic oil represented by the following general formula:

$$ROCO(CH_2)_nCOOR'$$

wherein R and R' represent an alkyl group having a 3–18 carbon atoms, and may be the same or different, and n is 3–12.

4. A grease composition for motor bearings as claimed in claim 1, wherein the ester-based synthetic oil (C) is the tetraester-based synthetic oil represented by the following general formula:

$$C(CH_2(OCOR)_4$$

wherein R represents an alkyl group having 3–10 carbon atoms.

5. A grease composition for motor bearings as claimed in claim 1, wherein the motor bearing is used for a household electric appliance.

6. A grease composition for motor bearings as claimed in claim 1, wherein the grease composition comprises 5–30 parts by mass of the thickener and 70–95 parts by mass of the base oil, and wherein a ratio of (B)/((B)+(C)) of said mixture is 0.1 to 0.95 by mass.

7. A grease composition for motor bearings as claimed in claim 1, wherein the grease composition consists essentially of 5–30 parts by mass of the thickener and 70–95 parts by mass of the base oil, and wherein a ratio of (B)/((B)+(C)) of said mixture is 0.1 to 0.95 by mass.

* * * * *